US008387533B2

(12) United States Patent
Runkel

(10) Patent No.: US 8,387,533 B2
(45) Date of Patent: Mar. 5, 2013

(54) DOWNHOLE PERFORATING GUN SWITCH

(76) Inventor: Kevin D. Runkel, Midland, TX (US)

( * ) Notice: Subject to any disclaimer, the term of this patent is extended or adjusted under 35 U.S.C. 154(b) by 55 days.

(21) Appl. No.: 13/082,065

(22) Filed: Apr. 7, 2011

(65) Prior Publication Data

US 2012/0255842 A1 Oct. 11, 2012

(51) Int. Cl.
*F42C 15/40* (2006.01)

(52) U.S. Cl. ..... 102/263; 102/328; 102/262

(58) Field of Classification Search ..... 102/262–264, 102/325–333

See application file for complete search history.

(56) References Cited

U.S. PATENT DOCUMENTS 3,173,992 A * 3/1965 Boop ..... 174/151
4,234,768 A 11/1980 Boop
4,457,383 A 7/1984 Boop
4,852,494 A 8/1989 Williams
5,052,489 A * 10/1991 Carisella et al. ..... 166/297
5,115,865 A * 5/1992 Carisella et al. ..... 166/297
5,531,164 A 7/1996 Mosley
2008/0047456 A1 * 2/2008 Li et al. ..... 102/310
2010/0051440 A1 3/2010 Hurst

* cited by examiner

*Primary Examiner* — Michael David
(74) *Attorney, Agent, or Firm* — Geoffrey A. Mantooth

(57) ABSTRACT

A downhole perforating gun switch is located in the sub housing and has first, second and intermediate contacts, with the intermediate contact located between the first and second contacts. In an initial position, the intermediate and second contacts are in contact with each other, while the intermediate and first contacts are out of contact with each other. A thermoplastic plug is positioned between the intermediate and second contacts. A conductive sleeve or enclosure provides the electrical contact between the intermediate and second contacts. When the switch is subjected to detonation effects from the perforating gun, the second contact, the plug, and the intermediate contact are moved toward the first contact, wherein the first and intermediate contacts contact each other and the intermediate and second contacts are out of contact with each other.

12 Claims, 5 Drawing Sheets

DOWNHOLE PERFORATING GUN SWITCH

FIELD OF THE INVENTION

The present invention relates to switches for downhole perforating guns.

BACKGROUND OF THE INVENTION

Perforating guns are used to create openings or perforations in pipe or tubular goods. In an oil or gas well, a perforating gun is lowered into the well inside of the pipe, down to the level of the oil or gas bearing formation. The perforating gun is then fired and the pipe is perforated to allow fluids from the formation to enter the pipe. Perforating guns use shaped charges or some other devices to create the actual openings in the pipe.

When a pipe is perforated, typically a long string of perforating guns is used. It is desirable to have control and fire off specific segments of the perforating gun string, rather than fire the entire perforating gun string at once.

The prior art accomplishes this task of selective activation by using a single wire system. The perforating gun string is made up of perforating gun subs, which contain the shaped charges that perform the actual perforating, alternated with switch subs. The switch sub contains an electrical switch. There is a switch for each perforating gun sub. The perforating gun string is fired from the bottommost perforating gun sub up towards the surface. The switches, typically located adjacent to the bottom portion of the respective perforating gun sub, provides electrical contact therethrough to the next lowermost perforating gun sub, while preventing electrical contact with the circuit inside of the associated and respective perforating gun sub. Thus, electrical current can be passed through a particular sub to the lowermost perforating gun sub. When needed, the switch makes electrical contact between the power supply on the surface with its respective perforating gun sub.

When a perforating gun sub is detonated, it creates a blast of pressure and heat that is used to close the adjacent upper switch in the adjacent upper sub. Thus, the next upper perforating gun sub is activated and ready for use.

The switches are an important component of the perforating gun string. If a switch fails, the operation of the entire string can be jeopardized. Because the switch is activated or closed by a blast from a perforating gun, prior art switches tend to have reliability problems. A perforating gun may generate a blast that overpressures and overwhelms the switch.

SUMMARY OF THE INVENTION

A downhole perforating gun switch is provided, which comprises a sub housing. A body has first and second ends with a bore extending between the two ends. The body is located in the sub housing such that the second end is exposed to detonation effects. A first electrical contact is located adjacent to the body first end. A conductor is located in the bore. A second electrical contact is located in the bore adjacent to the body second end. An intermediate electrical contact is located in the bore and is interposed between the first contact and the second contacts. A thermoplastic plug is located in the sleeve between the intermediate and second contacts. The plug, the intermediate contact and the second contact move between a first position in the sleeve, wherein there is electrical continuity between the intermediate contact and the second contact and electrical discontinuity between the intermediate contact and the first contact, and a second position, where there is electrical continuity between the first contact and the intermediate contact and electrical discontinuity between the intermediate contact and the second contact.

In accordance with one aspect, there is further provided a seal inside of the conductor and adjacent to the second contact.

In accordance with another aspect, the body is non-conductive and made of a composite material.

In accordance with still another aspect, the conductor comprises a sleeve and the second and intermediate contacts and the plug are located in the sleeve.

In accordance with still another aspect, the sleeve has a first end located adjacent to the intermediate contact. The first end is crimped so as to retain the intermediate contact.

In accordance with still another aspect, the sleeve has a second end portion located adjacent to the second contact. The second end portion is crimped so as to retain the second contact.

In accordance with still another aspect, the sleeve has a lip extending radially outward from the second end portion. The lip is located adjacent to the body second end.

In accordance with still another aspect, the intermediate contact is connected to a wire, with the wire extending through the first contact to an exterior of the body.

In accordance with still another aspect, a diode is connected to the first contact.

There is also provided a method for activating a downhole perforating gun switch. A first electrical contact, a second electrical contact and an intermediate electrical contact are provided in an initial position, where the intermediate and second contacts are electrically connected and the intermediate and first contacts are not electrically connected. A non-conductive plug is provided between the intermediate and second contacts. The second contact is subjected to detonation effects from a perforating gun. The detonation effects move the intermediate contact and plug so that the intermediate contact makes electrical contact with the first contact and breaks electrical contact with the second contact. A seal from well fluids is formed about the first and intermediate contacts with the plug.

In accordance with another aspect, the step of providing contact between the intermediate and second contacts in the initial position further comprises providing a conductive enclosure for the intermediate and second contacts and the plug.

In accordance with another aspect, the plugs and the intermediate contact are retained in the enclosure by a frangible retainer.

In accordance with another aspect, the second contact is retained in the enclosure.

In accordance with another aspect, the enclosure is retained at one end of a switch body, with the first contact at another end of the body.

DESCRIPTION OF THE PREFERRED EMBODIMENT

In the description herein, terms such as "upper", "above", "lower" and "below" are used with reference to the orientation shown in the figures. However, the devices shown herein can be used in any orientation.

Figure 1:
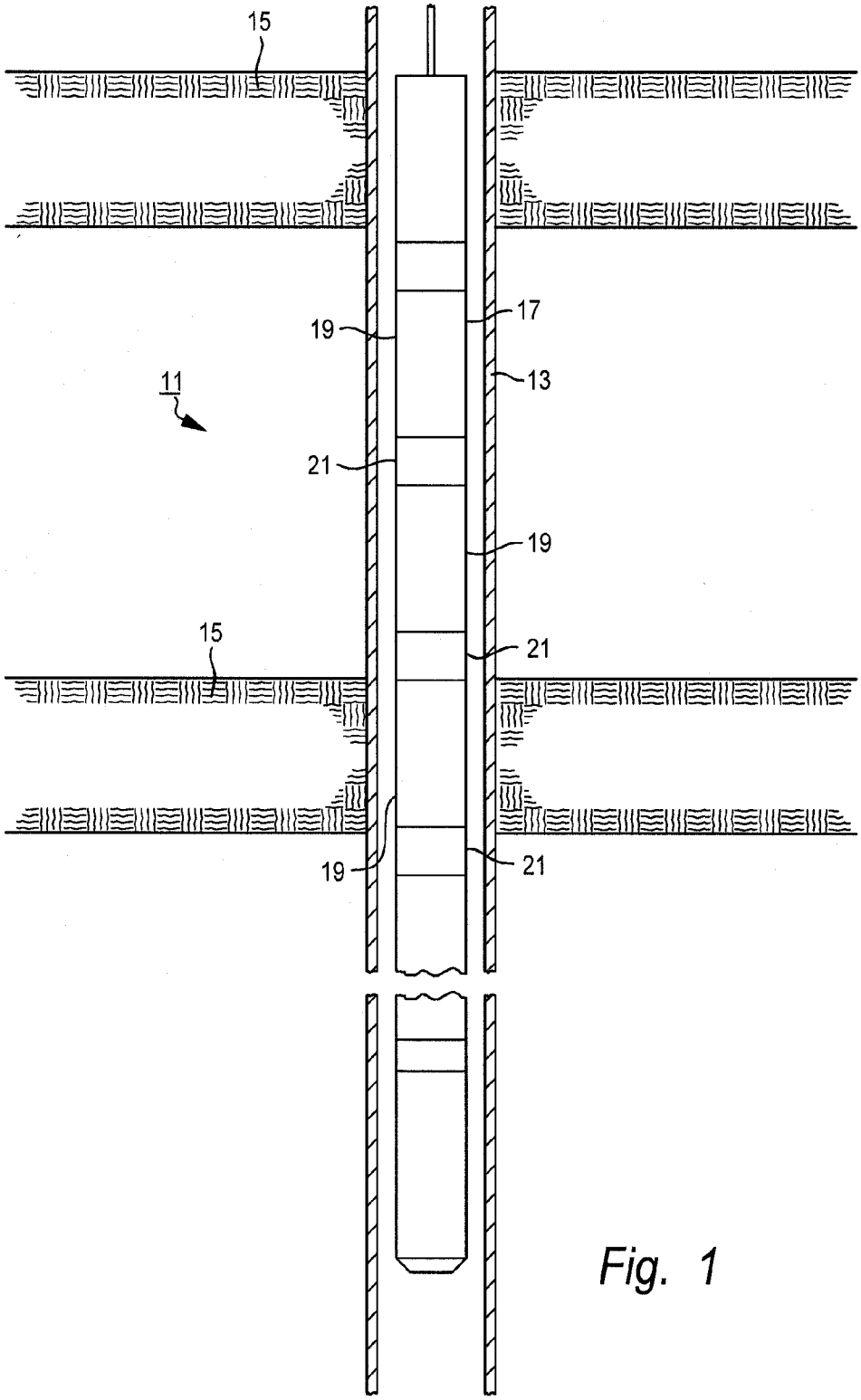
FIG. 1 is a schematic cross-sectional view of a perforating gun string in a well.

In FIG. 1, there is shown an oil or gas well 11. The well has piping in the form of casing 13 lining the well. The well 11 extends from the surface of the earth to some depth, and penetrates one or more formations 15 that contain oil or gas or both.

When the casing 13 is installed in a well, it is unperforated. In order to have fluids, such as oil and gas, exit the formation 15 and enter the well, the casing 13 must be perforated at the formation. Perforating creates openings for the oil and gas to flow through. A perforating gun string 17 is used to create the perforations in the casing 13. Once the casing is perforated, the perforating gun string is then removed from the well.

Figure 2:
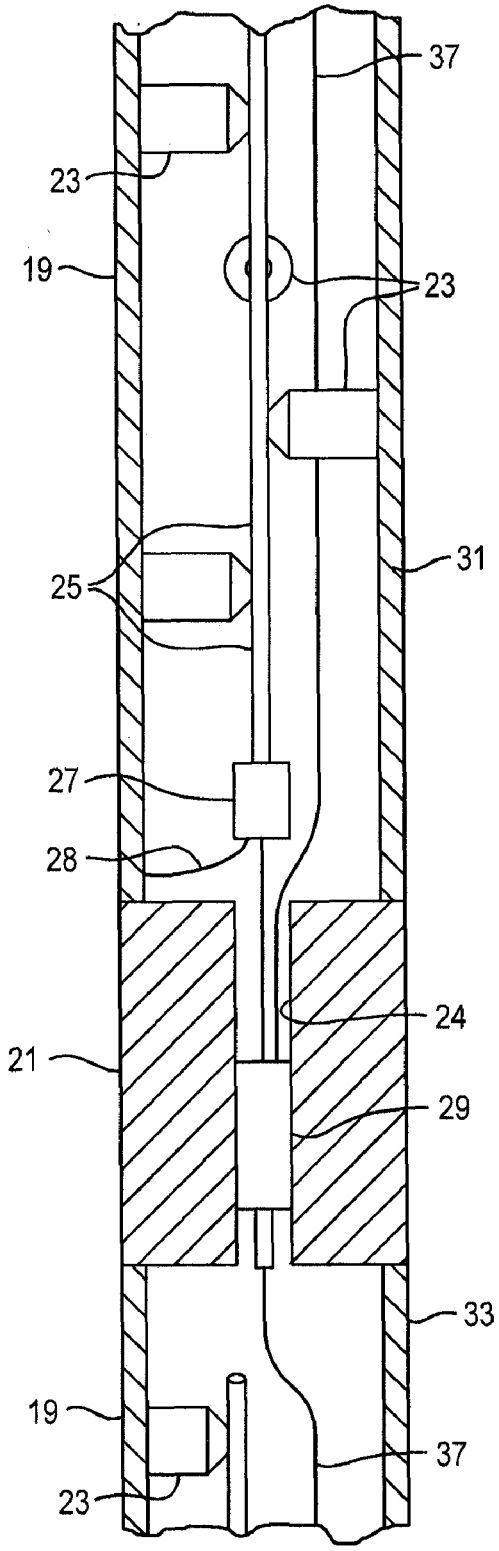
FIG. 2 is a schematic cross-sectional view of a perforating gun and switch sub.

The perforating gun string 17 is made up of perforating gun subs 19 and switch subs 21. Referring to FIG. 2, a schematic of a perforating gun sub 19 and a switch sub 21 is shown. The perforating gun sub has a number of shaped charges 23 located therein. The shaped charges face radially outward so that when detonated, they fire into the casing 13. Detonating cord 25 runs along the shaped charges. An electrical detonator 27 is coupled to the detonating cord. The detonator 27 is electrically connected to a power supply on the surface by way of one or more switches 29. The detonator 27 is grounded by a wire 28 attached to the perforating gun sub housing 31. The housing 31 is electrically conductive. The housings 31 of all of the perforating gun subs 19 and the housings 33 of the switch subs 21 form an electrical conductor. The subs 19, 21 are provided with seals so as to keep well fluids out of the housing interiors. In the prior art, some perforating gun subs are designed so that if the interior becomes wet from the well fluids, then the gun will not fire.

The switch 29 is located in the switch sub 21 below the respective perforating gun sub 19. The switch sub 21 has connectors in the form of threads that allow connection to other subs in the string. The switch sub 21 is a solid cylinder of metal with a passage 24 therethrough. The passage 24 receives the switch 29. The switch 29 has two ends, one of which is exposed to the perforating gun sub located below.

Figure 3:
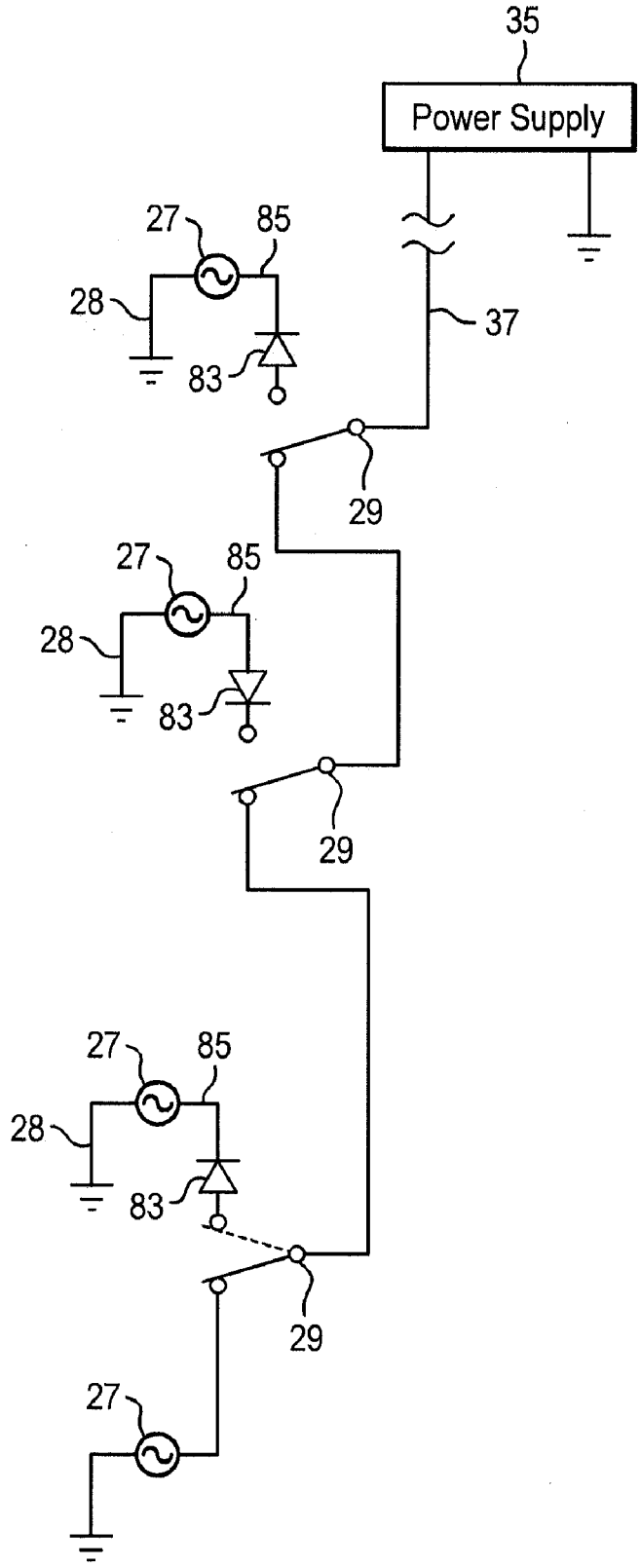
FIG. 3 is a schematic diagram of the electrical circuit of the perforating gun string.

Electrically, the circuit is as shown in FIG. 3. Each perforating gun sub 19 has a detonator 27 and each switch sub 21 has a switch 29. The surface power supply 35 is connected to a wire 37 that extends through all of the perforating gun subs and is connected to the switches 29. The power supply 35 is also connected to the perforating gun string ground.

The switches 29 are connected in series between the power supply and to ground via a respective one of the detonators 27. In general, the lowermost perforating gun sub is activated or fired, with the perforating gun subs that are above that one sub being incapable of activation due to open switches 29. When a perforating gun sub is fired, an electrical current is provided to the detonator 27 which in turn detonates the detonating cord 25, which in turn fires the shaped charges 23. The detonating cord and shaped charges generate a blast wave inside of the perforating gun sub housing 31. This blast provides pressure and heat to the switch sub located above. Thus, the lower perforating gun activates the upper adjacent switch, shown by the dashed line in FIG. 3, and disconnects the circuit below the switch, while connecting the circuit and the detonator that is immediately above the switch.

U.S. Pat. Nos. 4,234,768 (Boop) and 4,852,594 (Williams) describe perforating guns and the electrical circuitry and switching; the entire disclosures of these patents are incorporated by reference herein.

Figure 4:
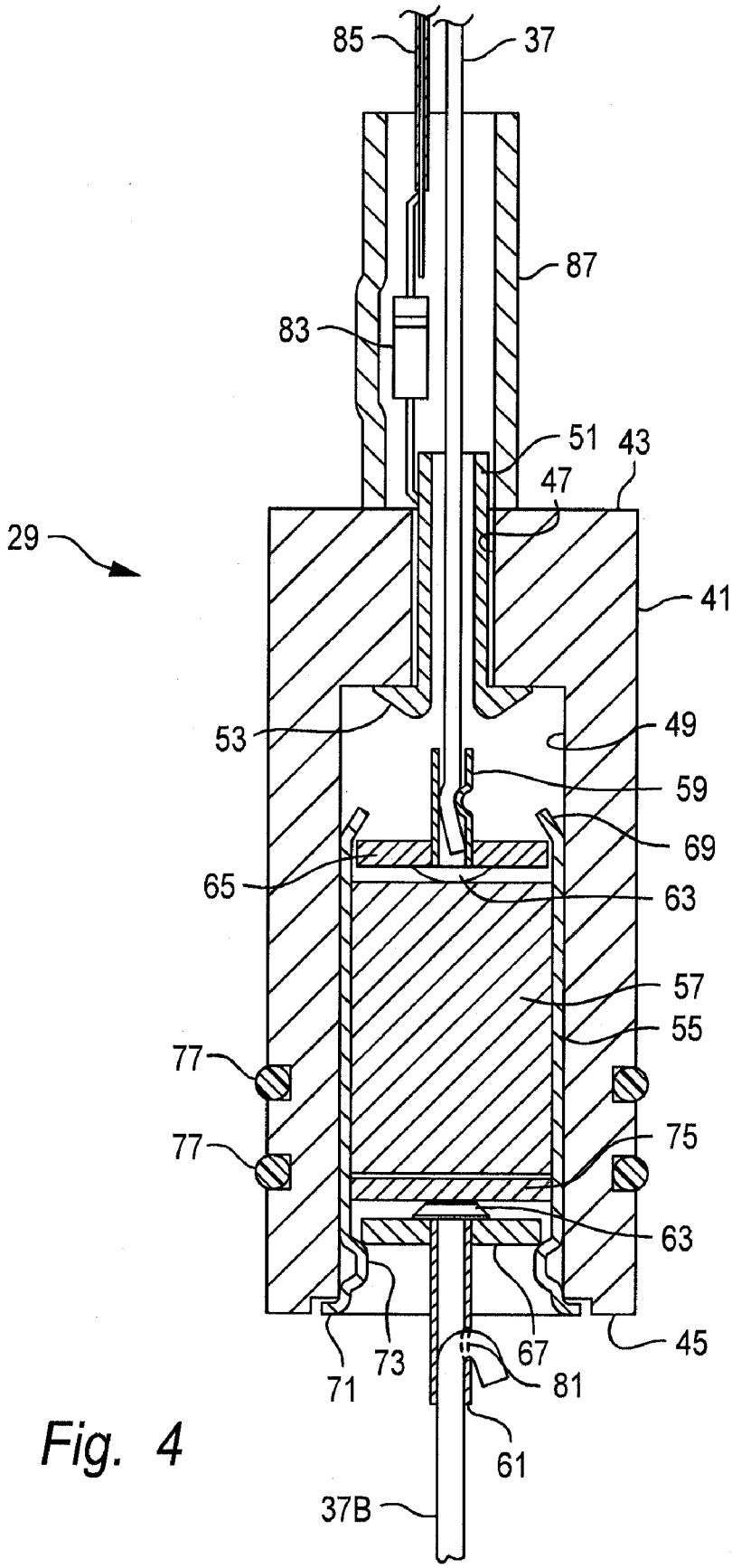
FIG. 4 is a cross-sectional view of the unactivated switch, in accordance with a preferred embodiment.

Referring to FIG. 4, the switch 29 will now be described in more detail. The switch has a body 41 that is generally cylindrical. The body has an upper end 43 and a lower end 45. The upper end 43 has a passage or bore 47 aligned with the longitudinal axis of the housing. The lower end 45 has a counterbore 49 that intersects the passage 47. In the preferred embodiment, the housing 41 is made of a non-conductive composite material such as phenolic, carbon fiber, etc. In general, composites have a matrix fiver material and a resin material. I have found that composites have the ability to withstand the detonation effects with little of no damage. Phenolic is a composite made of linen or paper fibers and epoxy.

An upper contact 51 extends from the counterbore 49 into the passage 47 and extends from the upper end 43 for a distance. The upper contact 51 has a tubular sleeve located in the passage 47 and a head 53 located in the counterbore 49. The upper contact is press fit into the passage 47.

A contact tube or sleeve or enclosure 55 is located in the counterbore 49 from the bottom end 45 to provide electrical contact between the intermediate and second contacts. The contact sleeve 55 is electrically conductive and receives an insulating spacer, or plug, 57, an intermediate contact 59 and a lower contact 61. The insulating spacer 57 is located between the intermediate and lower contacts 59, 61. The insulating spacer 57 is made of a thermoplastic polymer such as polytetrafluoroethylene (PTFE). The intermediate and lower contacts 59, 61 are both similar to the upper contact 51, having a hollow sleeve for receiving a wire and a head 63. Each of the intermediate and lower contacts 59, 61 is provided with a conductive retaining washer 65, 67. The washers are located inside of the contact sleeve 55. The heads 63 of the intermediate and lower contacts 59, 61 are interposed between the insulating spacer 57 and the respective washers 65, 67. There is a gap between the intermediate contact 59 and the upper contact 51.

The intermediate contact 59 and the spacer 57 are retained in the sleeve 55 by a frangible retainer. In the preferred embodiment, the upper end 69 of the contact sleeve 55 is crimped inwardly so as to retain the intermediate contact in place. The crimping forms a frangible retainer. The lower end of the contact tube is crimped outwardly to provide a retaining lip 71. Located upwardly from the lip, the contact tube is crimped inwardly 73 so as to retain the lower contact in place.

A seal 75 in the shape of a disk is located between the lower contact 61 and tube insulating spacer 57. The seal 75 prevents fluid from entering the switch through the interior of the contact sleeve 55. A seal is formed between the contact sleeve 55 and the body 41 by the tight fit between the two. O-ring seals 77 are provided on the outer circumference of the body to seal against the switch sub 21.

The main wire 37 is connected to the surface power supply 35 and passes through the upper contact 51 and is secured to the intermediate contact 59, such as by crimping. The wire 37 is insulated from the upper contact 51. Another wire 37B is secured to the lower contact 61. The lower contact sleeve is provided with a hole 81; the wire is inserted into the sleeve and passed out of the hole, wherein the sleeve is then crimped. This arrangement provides a better coupling of the wire to the lower contact. In the prior art, sometimes the wire pulls free of the lower contact.

A diode 83 is secured, such as by soldering, to the upper contact 51. The diode 83 is connected to a wire 85 which in turn is connected to a detonator 27. The diodes and the switches alternate polarity so that every other switch in the perforating gun string allows a positive current to fire the detonator, with the remaining switches allowing a negative current to fire the detonators. An insulating sleeve 87 can be provided around the diode.

In operation, the switch is normally configured as shown in FIG. 4. An electrical circuit is made between the two wires 37, 37B, by way of the intermediate contact 59, the contact sleeve 55 and the lower contact 61 (wire 37B is so named to distinguish it from wire 37 in FIG. 4, but is shown as wire 37 in FIG. 2). The intermediate contact 59 is electrically isolated from the upper contact 51, thus the respective detonator that is connected to the upper contact cannot be detonated.

As shown in FIG. 3, the lowermost detonator 27 is connected to the power supply 35 (the lowermost detonator need not be provided with a switch). The lower end 45 of the switch is exposed to the interior of the perforating gun below the switch. Thus, when that lower perforating gun detonates, the detonation effects such as pressure and heat, act on the switch.

Figure 5:
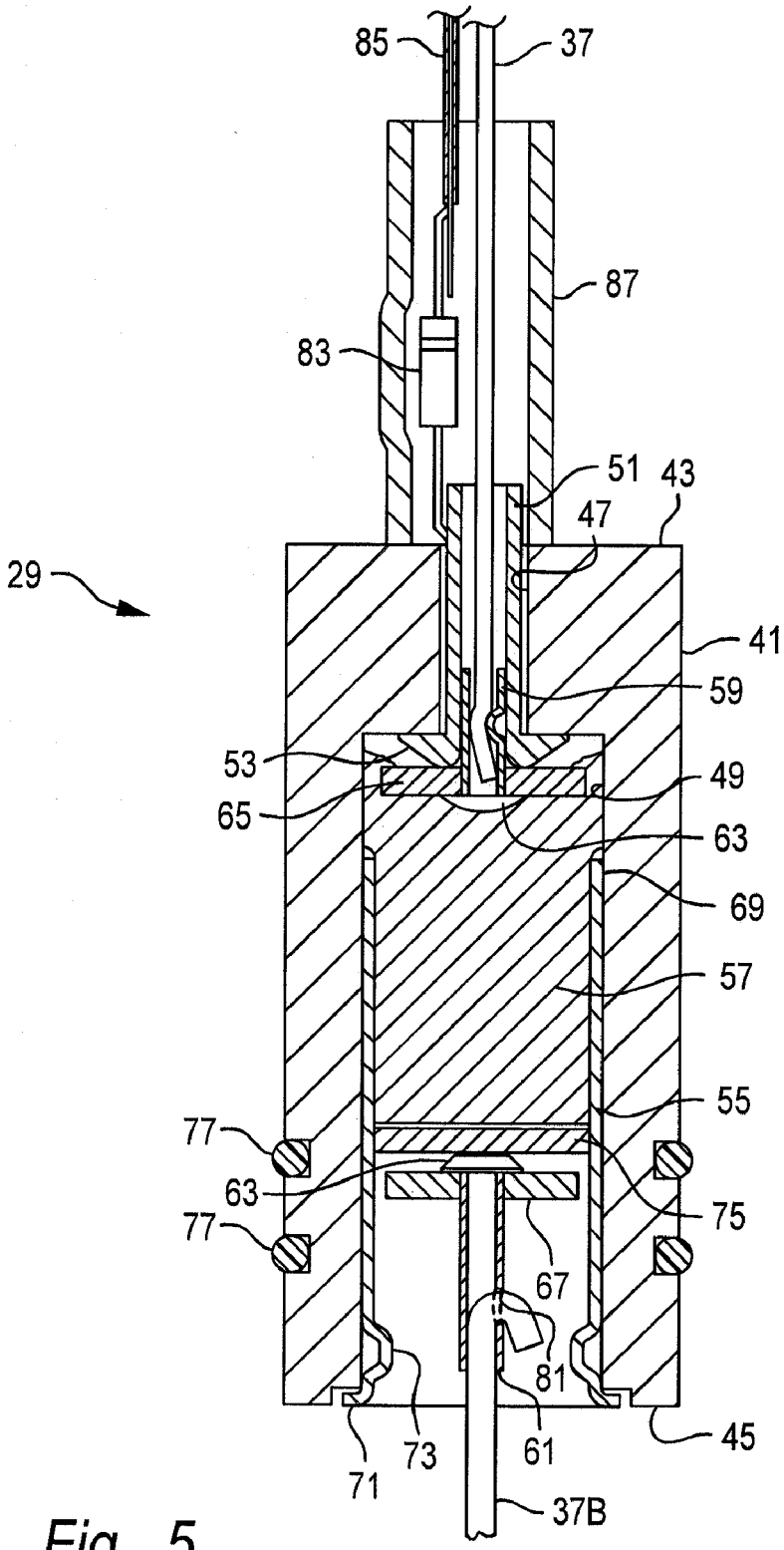
FIG. 5 is a cross-sectional view of the switch of FIG. 4, after activation.

The blast from the detonation applies force to the lower contact 61 and its respective washer 67, as well as to the seal 75, the insulating spacer 57 and the intermediate contact 59 and its respective washer 65. The intermediate contact washer 65 forces the crimped end 69 of the contact sleeve 55 to open and the insulating spacer 57 now moves from its position shown in FIG. 4 to its position shown in FIG. 5. The intermediate contact 59 is pushed out of the contact sleeve 55, breaking electrical contact with the lower contact 61, and into electrical contact with the upper contact 51. The insulating spacer 57, being thermoplastic, is plastic under the heat and pressure of the detonation and fills in the counterbore 49 to the extent of providing a seal inside of the counterbore. Once the heat and pressure dissipates, the spacer 55 loses its plasticity and forms a solid seal. The seal prevents the intrusion of wellbore fluids into the perforating gun sub located above the switch. Thus, the sub remains dry and is able to function when detonated.

The breaking of electrical contact between the intermediate and lower contacts is desirable because after detonation, well fluids enter the perforating gun that has just detonated. The well fluids often contain slat water, a conductive fluid that can effectively short out the lower contact to ground. If this were allowed to happen, the perforating gun string would no longer be able to fire.

The switch 29 is highly reliable and will activate under a range of detonating pressures and temperatures. This is in contrast to prior art switches which tend to break if exposed to over pressures. In the switch 29, the insulating spacer 57 serves to absorb some of the blast effects from the detonation, protecting the upper and intermediate contacts 51, 59.

Before detonation, the switch relies on the seal 75 to seal the interior from the well fluids. The washer 67 protects the seal 75 from the detonation effects so that the seal remains intact and functioning. However, if the seal 75 should fail, the insulating spacer 57 being thermoplastic in nature, expands into the body 41 and provides a seal around the intermediate and upper contacts 59, 51. The o-rings 77 on the exterior of the body remain intact.

The provision of the insulated body 41 simplifies the switch as fewer components are needed. Prior art switches use conductive bodies and require insulated components between the electrical contacts or conductors and the housing.

The foregoing disclosure and showings made in the drawings are merely illustrative of the principles of this invention and are not to be interpreted in a limiting sense.

The invention claimed is:

1. A downhole perforating gun switch, comprising:

a) a sub housing;

b) a body having first and second ends, with a bore extending between the first and second ends, the body located in the sub housing such that the second end is exposed to detonation effects;

c) a first electrical contact located adjacent to the body first end;

d) a conductor located in the bore;

e) a second electrical contact located in the bore adjacent to the body second end;

f) an intermediate electrical contact located in the bore interposed between the first contact and the second contact;

g) a thermoplastic plug located in the sleeve between the intermediate and second contacts;

h) the plug, the intermediate contact and the second contact movable between a first position in the sleeve, wherein there is electrical continuity between the intermediate contact, the conductor and the second contact and electrical discontinuity between the intermediate contact and the first contact, and a second position, wherein there is electrical continuity between the first contact and the intermediate contact and electrical discontinuity between the intermediate contact and the second contact.

2. The downhole perforating gun switch of claim 1, further comprising a seal inside of the conductor and adjacent to the second contact.

3. The downhole perforating gun switch of claim 1 wherein the body is non-conductive and made of a composite material.

4. The downhole perforating gun switch of claim 1 wherein the conductor comprises a sleeve, the second and intermediate contacts and the plug are located in the sleeve.

5. The downhole perforating gun switch of claim 4 wherein the sleeve has a first end located adjacent to the intermediate contact, the first end being crimped so as to retain the intermediate contact.

6. The downhole perforating gun switch of claim 5 wherein the sleeve has a second end portion located adjacent to the second contact, the second end portion being crimped so as to retain the second contact.

7. The downhole perforating gun switch of claim 6 wherein the sleeve has a lip extending radially outward from the second end portion, the lip located adjacent to the body second end.

8. The downhole perforating gun switch of claim 4 wherein the sleeve has a second end portion located adjacent to the second contact, the second end portion being crimped so as to retain the second contact.

9. The downhole perforating gun switch of claim 4 wherein the sleeve has a lip extending radially outward from the second end portion, the lip located adjacent to the body second end.

10. The downhole perforating gun switch of claim 1 wherein the intermediate contact is connected to a wire, the wire extending through the first contact to an exterior of the body.

11. The downhole perforating gun switch of claim 1, further comprising a diode connected to the first contact.

12. The downhole perforating gun switch of claim 1, further comprising:

a) the conductor comprises a sleeve, a seal inside of the conductive sleeve and adjacent to the second contact;

b) the body is non-conductive and made of a composite material;

c) the second and intermediate contacts and the plug are located in the sleeve;

d) the sleeve has a first end located adjacent to the intermediate contact, the first end being crimped so as to retain the intermediate contact;

e) the sleeve has a second end portion located adjacent to the second contact, the second end portion being crimped so as to retain the second contact;

f) the sleeve has a lip extending radially outward from the second end portion, the lip located adjacent to the body second end;

g) the intermediate contact is connected to a wire, the wire extending through the first contact to an exterior of the body;

h) a diode connected to the first contact.

* * * * *